United States Patent [19]

Ramelot

[11] 4,042,378

[45] Aug. 16, 1977

[54] CONTROLLING PIG IRON REFINING

[75] Inventor: Daniel Léon Ramelot, Saint-Nicolas, Belgium

[73] Assignee: Centre de Recherches Metallurgiques-Centrum voor Research in de Metallurgie, Brussels, Belgium

[21] Appl. No.: 682,668

[22] Filed: May 3, 1976

[30] Foreign Application Priority Data

May 7, 1975 Belgium ..... 828855

[51] Int. Cl.[2] ..... C21C 5/30

[52] U.S. Cl. ..... 75/60

[58] Field of Search ..... 75/60

[56] References Cited

U.S. PATENT DOCUMENTS 3,533,778 10/1970 Nilles ..... 75/60

*Primary Examiner*—P. D. Rosenberg

[57] ABSTRACT

Industrially pure oxygen is blown into molten pig iron in a converter by means of at least one tuyere located below the upper surface of the molten metal. A quantity (such as amplitude, frequency, acceleration, or speed) characterizing movement of the converter is measured continuously while the oxygen is blown in. An instant at which this quantity undergoes a sudden and considerable decrease is detected. From that instant onwards, the amount of oxygen necessary and sufficient to provide the steel with a desired quality is blown in. The required amount of oxygen is determined from an empirical relationship between the amount of oxygen blown in after the instant and either the phosphorus content of the steel or the iron content of the slag.

7 Claims, 3 Drawing Figures

CONTROLLING PIG IRON REFINING

BACKGROUND OF THE INVENTION

The present invention relates to a pig iron refining process in which industrially pure oxygen is blown in by means of at least one tuyere located below the surface of the molten metal in a converter.

In known installations the tuyere is generally in the bottom of the converter and comprises two co-axial ducts, the inner duct being arranged to convey oxygen whereas the space between the inner duct and the outer duct is designed to convey a fluid, preferably an endothermic-decomposition fluid such as a hydrocarbon liquid or gas, to protect the tuyere and the refractory materials against the action of the oxygen.

Input and output parameters are monitored and input parameters are controlled in order to obtain steel of a desired quality. Fixed input parameters include the temperature and composition of the pig iron; variable input parameters include oxygen flow rate and the amount and timing of additions to the molten metal; output parameters include the temperature and composition of the waste gases. The desired quality may be, for example, the content of at least one component of the steel.

A number of methods of controlling the refining operation when blowing oxygen through the bottom of the converter have already been suggested, for example methods based on material and heat balances and a mathematical model for calculating charges.

Theoretically, such methods permit the desired composition and temperature for the refined metal to be regularly obtained upon turn-down of the converter. However, a certain scatter of the results thus obtained occurs in practice. The dispersion may be due to a lack of information on the charged materials, for example on the weight or the precise composition of the pig iron, the scrap, or the lime. To remedy such a situation, premature turn-down of the converter is generally provided, the iron content and the temperature of the slag are rapidly measured, and blowing is re-started with or without additions and is continued for the time necessary to obtain the desired composition and temperature of the steel.

The results thus obtained have been found to be satisfactory. Scatter, which generally occurs when no premature turn-down is practiced, is substantially reduced. However, premature turn-down of the converter has the disadvantage of prolonging the duration of the refining operation.

SUMMARY OF THE INVENTION

An object of the present invention is to provide a process which allows this disadvantage to be eliminated and refining to be terminated with no need for the converter to be prematurely turned down.

It has unexpectedly been found that, by observing the movement of the converter, it is possible to detect two instants which are significant for the refining operation, viz. first of all the instant at which the slag melts, and a little later the instant at which dephosphorization terminates. The movement of the converter may be characterized by its amplitude, speed, or acceleration. It has also been possible to experimentally determine the existence of a relationship between (a) the amount of oxygen blown in starting from either of these significant instants and (b) the phosphorus content of the steel or the iron content of the slag. Accordingly, measurement of the movement of the converter may be used for determining the precise moment at which the refining operation is terminated.

In view of the above, the process according to the present invention comprises measuring a quantity characterizing movement (or vibration) of the converter while the oxygen is blown in, detecting the instant (or one of the two instants) at which the quantity undergoes a sudden and substantial decrease, and, from the instant onwards, blowing into the converter the amount of oxygen necessary and sufficient to attain at the end of refining the desired quality of the steel, the amount of oxygen being determined from an empirical relationship, previously determined for the installation employed, between the amount of oxygen blown in after the instant and either the phosphorus content of the steel or the iron content of the slag depending on the nature of the sudden decrease in the quantity.

One can conveniently measure the movement of the converter in the direction of the longitudinal axis passing through the center of the pivot pins of the converter.

The amplitude and/or the frequency of the movement of the converter may conveniently be measured. Alternatively, the movement of the converter may be characterized by the acceleration thereof or the speed thereof.

The movements of the converter are preferably measured in the frequency range of up to 50 Hertz, more preferably between 10 and 25 Hertz.

Of course, the above described procedure may be combined with any method of carrying out the refining operation before determining the oxygen blowing-in termination. For example, it is possible to proceed as follows:

a. one performs refining during a first period by blowing in oxygen a constant flow rate, the flow rate value being determined by means of a diagram indicating the influence, on this quantity, of parameters such as the age of the converter, the silicon content of the pig iron, the amount of pig iron charged into the converter, and the weight of ore charged into the converter;

b. one measures the carbon monoxide content in the waste gases leaving the converter, determines the instant at which the CO content undergoes a sudden and substantial decrease, and, from the appearance of this decrease onwards, one ends the first refining period by modifying the oxygen flow rate, which is increased to the highest rate which is technically possible;

c. one performs a second refining period by keeping the oxygen flow rate at the maximum technically possible value;

d. the refining operation is terminated on the basis of measurements of the converter movement, in accordance with the process of the present invention.

BRIEF DESCRIPTION OF THE DRAWINGS

The invention will be described further, by way of example only, with reference to the accompanying drawings, in which.

DETAILED DESCRIPTION OF THE PREFERRED EMBODIMENT

Figure 1:
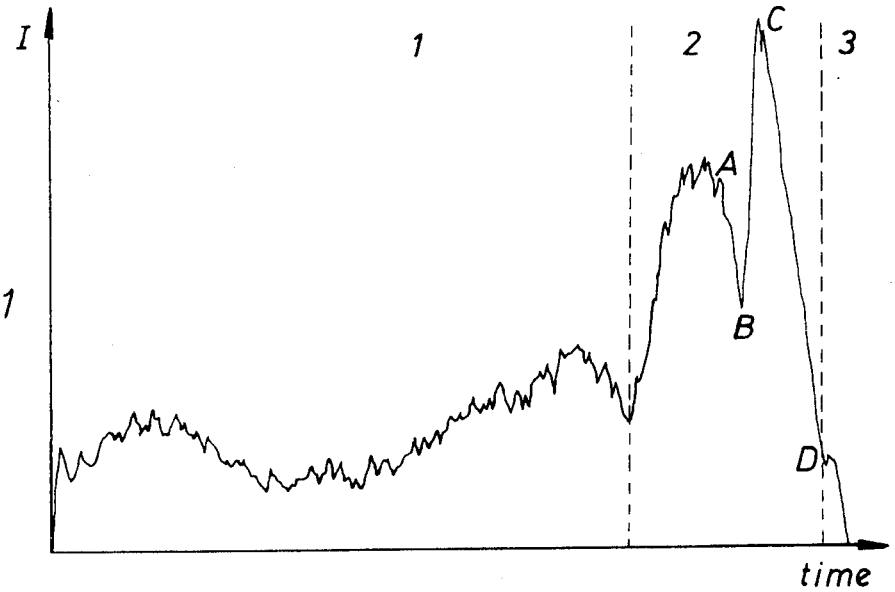
FIG. 1 is a graph of acceleration (I) of the converter (ordinates) against time (abscissae), the acceleration being measured in the direction of the longitudinal axis passing through the pivot pins of the converter.

With reference to FIG. 1, the course of the acceleration of the converter in the direction of the longitudinal axis passing through the centers of the pivot pins of the converter is recorded by an accelerometer in the range of frequencies of from 10 to 25 Hertz. This course may be subdivided into three periods closely related to the metallurgical phases of the process:

Phase 1: decarlburization, taking place during about three quarters of the total refining time;

Phase 2: dephosphorization, extending up to about 95% of the total refining time; the duration of this phase depends on the type of pig iron (phosphoric pig iron or hematite pig iron);

Phase 3: oxidation of iron, which determines the iron content of the slag, or the residual phosphorus content of the steel, and terminates the refining operation.

Phase 2 is characterized by two sudden and considerable drops (AB,CD) in the signal representing the converter acceleration amplitude measured in the direction of the longitudinal axis passing through the centers of the pivot pins. The first drop AB corresponds to the melting of the slag and the second drop CD corresponds to the end of the dephosphorization period. Each drop AB,CD may be easily observed by the converter operator on the diagram on which the signal representing the accelerations is recorded.

The drops (AB,CD) are both sharp and either of them may be used as the reference point from which a given volume of oxygen will be blown in. The type of pig iron (hematite or phosphoric) may determine the choice.

Blowing in a predetermined volume of oxygen, from the selected reference point onwards, allows one to achieve, with good accuracy, a predetermined iron content of the slag, or a predetermined phosphorus content of the steel, when the converter is turned down.

Figure 2:
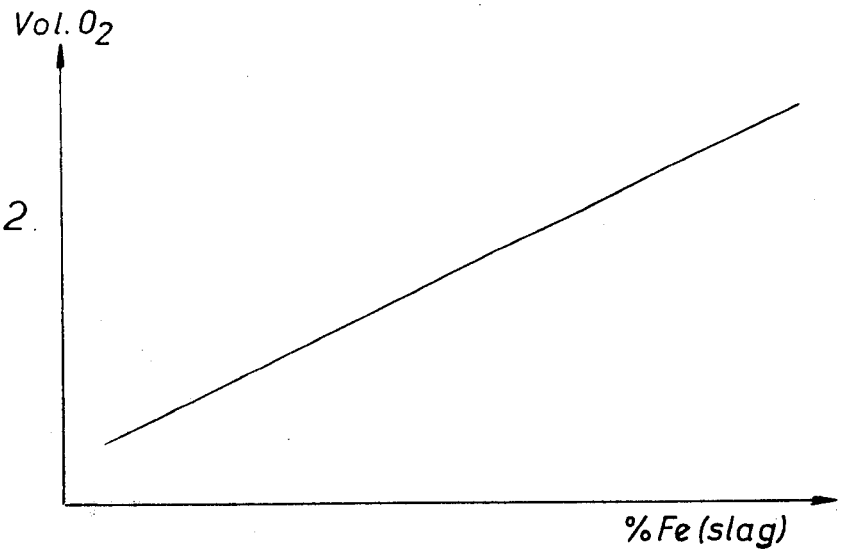
FIG. 2 is a graph of the empirical relationship, for the installation used, between the iron content of the slag (abscissae) and the volume of oxygen blown into the molten metal (ordinates) after a sudden and considerable decrease of the acceleration of the converter, this decrease corresponding to melting of the slag.

FIG. 2 illustrates the relationship between the iron content of the slag and the volume of oxygen blown in after the drop AB. It will be seen that the iron content of the slag increases with the volume of oxygen blown in. This relationship permits ready determination of the volume of oxygen to be blown in, after the sudden drop, in order to obtain a desired iron content of the slag.

Figure 3:
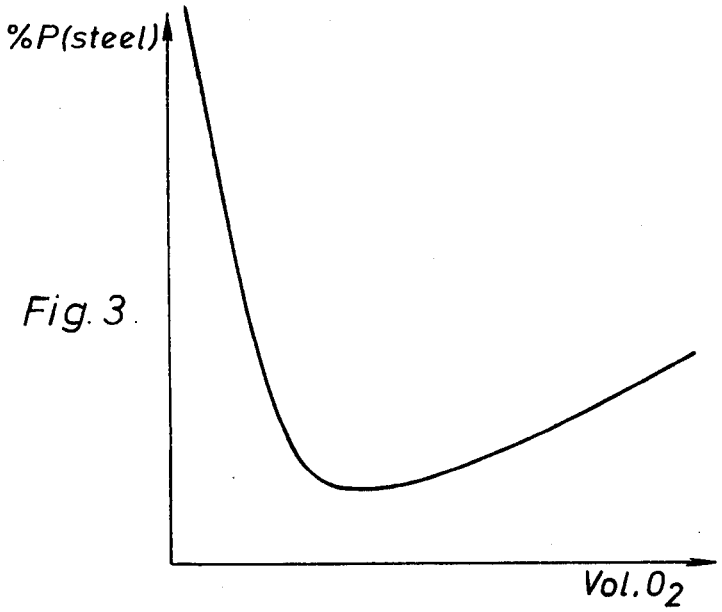
FIG. 3 is a graph of the empirical relationship, for the installation used, between the phosphorus content of the metal (ordinates) and the volume of oxygen blown into the molten metal (abscissae) after a sudden and considerable decrease in the acceleration of the converter, this decrease corresponding to the end of the dephosphorization period.

FIG. 3 illustrates the relationship between the phosphorus content of the steel and the volume of oxygen blown in after the drop CD. It will be seen that the curve representing the phosphorus content of the steel as a function of the volume of oxygen blown in after the sudden drop CD has a minimum. This relationship permits ready determination of the volume of oxygen to be blown in, after the sudden drop, in order to obtain a desired phosphorus content. Of course, the phosphorus content desired will usually correspond to the minimum.

Tests on samples of molten material taken during refining have shown that the above relationship actually correspond to a succession of reproducible states of the molten material.

I claim:

1. In a pig iron refining process in which industrially pure oxygen is blown into molten pig iron surmounted by a layer of slag in a converter by means of at least one tuyere located below the upper surface of the molten metal, in order to obtain steel of a desired quality, the improvement comprising the steps of: continuously measuring movement of the converter in the direction of an axis common to a pair of pivot pins on which the converter is pivotably mounted while the oxygen is blown in; detecting an instant at which the movement measurement undergoes a sudden and considerable decrease; and, from that instant onwards, blowing in only that amount of oxygen, which is necessary and sufficient to provide the steel with the desired quality at the end of the refining operation, the amount of oxygen being determined from an empirical relationship, determined from previous refining operations in the converter, between the amount of oxygen blown in after the instant and at least one of the phosphorus content of the steel and the iron content of the slag.

2. The process of claim 1, in which the measurement is the amplitude of the movement.

3. The process of claim 1, in which the measurement is the frequency of the movement.

4. The process of claim 1, in which the measurement is the acceleration of the movement.

5. The process of claim 1, in which the measurement is the speed of the movement.

6. The process of claim 1, in which the movement is in a frequency range of up to 50 Hertz.

7. The process of claim 6, in which the frequency range is between 10 and 25 Hertz.

* * * * *